US006098591A

United States Patent [19]

Iwata

[11] Patent Number: 6,098,591

[45] Date of Patent: Aug. 8, 2000

[54] MARINE ENGINE CONTROL

[75] Inventor: Yoshibumi Iwata, Hamamatsu, Japan

[73] Assignee: Sanshin Kogyo Kabushiki Kaisha, Hamamatsu, Japan

[21] Appl. No.: 09/080,864

[22] Filed: May 18, 1998

[30] Foreign Application Priority Data

May 16, 1997 [JP] Japan ..... 9-127440

[51] Int. Cl.[7] ..... F02M 3/00

[52] U.S. Cl. ..... 123/339.11; 123/406.52; 123/406.65

[58] Field of Search ..... 123/339.11, 406.52, 123/406.64, 406.65; 477/109

[56] References Cited

U.S. PATENT DOCUMENTS 4,872,436 10/1989 Schultes ..... 123/339.11
5,012,779 5/1991 Fukui et al. ..... 123/339.11
5,133,319 7/1992 Ikeda et al. ..... 123/339.11
5,450,828 9/1995 Sakamoto et al. ..... 123/339.11
5,588,409 12/1996 Mizuno et al. ..... 123/339.11

*Primary Examiner*—John Kwon
*Attorney, Agent, or Firm*—Knobbe, Martens, Olson & Bear LLP

[57] ABSTRACT

A number of embodiments of engine control for marine application wherein the engine is called upon to operate for long periods at speeds substantially below normal idling speed. This is encountered when trolling. The arrangement includes a system for substantially retarding the spark to assist in shifting and also to maintain stability when running at these low speeds. Adjustments may be made in air flow and fuel supply amounts so as to further augment the smooth running and avoid stalling under these trolling conditions. Various control routines for achieving appropriate ignition timing under the widely varying instantaneous speeds during trolling are also disclosed.

10 Claims, 15 Drawing Sheets

MARINE ENGINE CONTROL

BACKGROUND OF THE INVENTION

This invention relates to an engine control and more particularly to a marine engine control that improves running under extremely low speed operating conditions.

In many applications, internal combustion engines are utilized to propel vehicles and are required to run over a wide variety of running speed and load conditions. This presents significant problems in engine design and engine control. That is, the engine design and control can be configured to provide optimum running under some conditions, but then the running of the engine under other conditions will not be satisfactory.

Although computer controls permit a wider range of control capabilities, there are still circumstances where normal engine control strategy is not satisfactory.

A specific example in which engine control is quite difficult is in connection with marine operation. In marine operation, the engine is required many times to operate for fairly extended periods at speeds that are even lower than normal idle speed. This is encountered, for example, when the engine is operated to provide a trolling condition for the watercraft. Under this condition, the engine speed actually is less than idle speed. The reason for this is that the throttle is basically closed and the load on the engine is greater than when operating in neutral. As a result, lower than idle speeds result. At times the trolling speed is significantly lower than idle speed.

Also, there is a problem in ensuring that the engine continues to run for long periods under these trolling speeds. Stalling is a common problem in connection with trolling operations.

It is, therefore, a principal object of this invention to provide an improved engine control for arrangements where the engine operates under very low speeds and for extended periods.

It is a further object of this invention to provide an improved trolling engine control for a marine engine.

In conjunction with the operation at trolling or less than idle speeds, the engine may frequently be associated with a transmission and the transmission may be shifted from neutral to either a forward or reverse drive condition. When this occurs, the load on the engine significantly increases when the clutch is engaged and stalling can occur.

These problems may be somewhat compounded when shift controls are employed that provide an automatic speed reduction, for example, by cylinder disabling, when shifting from neutral to a drive condition. This type of engine speed reduction is utilized to facilitate shifting and to minimize loading on the transmission. However, it still further increases the likelihood of stalling.

It is, therefore, a further object of this invention to provide an improved marine engine control utilizing a transmission and wherein stalling under extreme low speed and shifting conditions will be avoided while shifting can still be facilitated.

SUMMARY OF THE INVENTION

A number of features of this invention are adapted to be embodied in a control system and a method of operating an engine having at least one combustion chamber, an induction system for supplying a charge to the combustion chamber, an ignition system for firing the charge in the combustion chamber and an exhaust system for discharging the burnt charge from the combustion chamber. An engine control and control method is provided that controls at least one of the systems for maintaining the desired engine running characteristics during normal running between idle and wide open throttle conditions. In addition, an arrangement is provided for employing a different form of control strategy from the normal engine control when the engine is operating at a sub-idle speed.

In accordance with a first of these features the system and method maintains running stability at these sub-idle speeds by retarding the spark timing significantly from the idle timing.

In accordance with another of these features the system and method maintains running stability at these sub-idle speeds by holding the throttle valve closed and by increasing the air flow from normal air flow at idle spark timing.

In accordance with yet another of these features the system and method maintains running stability at these sub-idle speeds by measuring instantaneous engine speed fluctuations during sub-idle running and adjusts the spark timing to be appropriate for the instantaneous speed at the time of firing.

DETAILED DESCRIPTION OF THE PREFERRED EMBODIMENTS OF THE INVENTION

Figure 1:
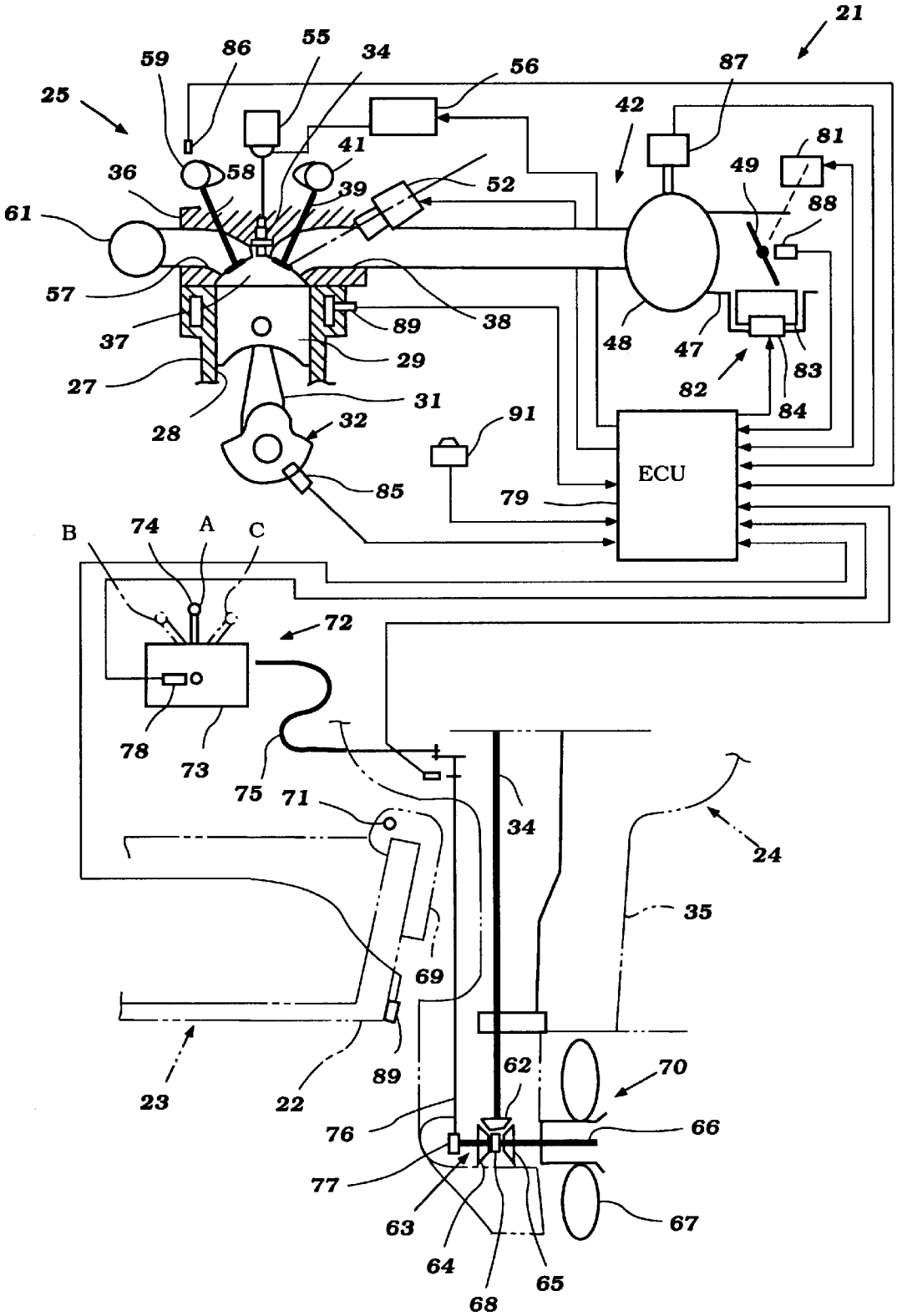
FIG. 1 is a multi-part view, in part schematic, showing a marine propulsion system constructed and operated in accordance with an embodiment of the invention.
Figure 2:
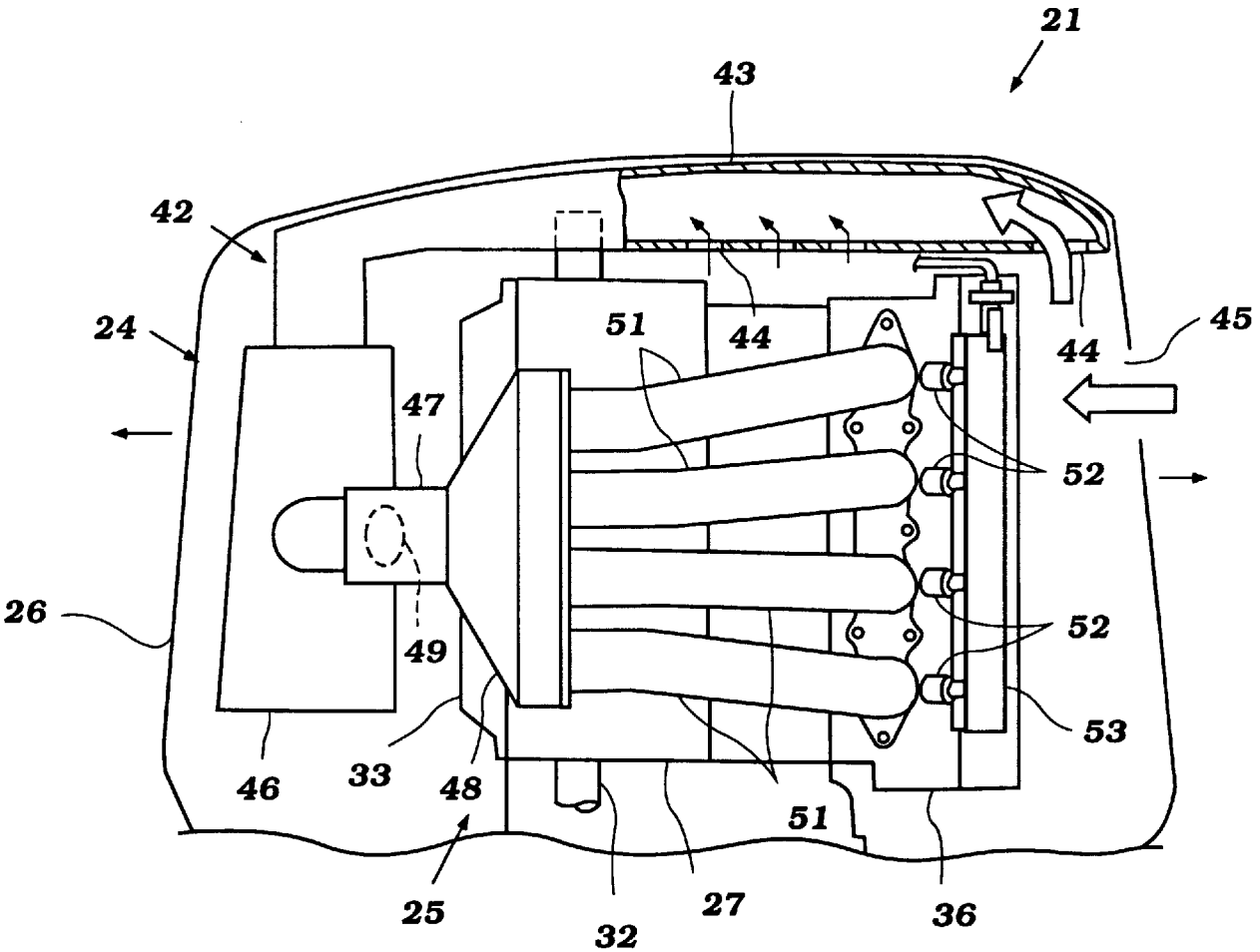
FIG. 2 is an enlarged view of the powerhead of the propulsion system, with portions broken away so as to more clearly show the construction.

Referring first to the embodiment of FIGS. 1–6, and initially to FIGS. 1 and 2, a marine propulsion system constructed and operated in accordance with the invention is indicated generally by the reference numeral 21. In the illustrated embodiment, the marine propulsion system 21 comprises an outboard motor. It is attached, in a manner to be described, to the transom 22 of a watercraft hull, shown partially and in phantom and identified generally by the reference numeral 23. The outboard motor 21 propels the watercraft hull 23 through a body of water.

Although this type of marine propulsion system is shown and described, those skilled in the art will readily understand how the invention can be practiced with other types of marine propulsion systems. Also, although the invention has specific application to such systems, it can be employed with other engine applications where an internal combustion engine may be called upon to operate for relatively long times at sub-idle speeds.

The outboard motor 21 is comprised of a power head, indicated generally by the reference numeral 24 and which is comprised in principle part of an internal combustion engine, indicated generally by the reference numeral 25 and a surrounding protective cowling 26.

In the illustrated embodiment, the engine 25 is of a four-cylinder, inline type that operates on a four cycle principle. It will be apparent to those skilled in the art that the invention can be utilized with engines having any number of cylinders and any desired cylinder configuration. The invention also may be utilized in conjunction with two cycle engines as well as the depicted four cycle engine. The invention, however, has particular utility in conjunction with four cycle engines because of the fact that each cylinder fires only once every second revolution. This tends to cause the instantaneous crankshaft speed to vary more significantly than with a two cycle engine. The significance of this will become apparent as this description proceeds.

The construction of the internal construction of the engine 25 is generally conventional and may be understood by reference to the partial cross-sectional view in FIG. 1. Where any details of the engine 25 are not illustrated, they may be considered to be of any known or conventional construction.

The engine 25 is comprised of a cylinder block 27 having a plurality of inline cylinder bores 28. As is typical with outboard motor practice, the engine 25 is supported in the power head 24 so that the cylinder bores 28 extend in a generally horizontal direction.

Pistons 29 reciprocate in the cylinder bores 28. These pistons 29 are connected by means of connecting rods 31 to a crankshaft 32. The crankshaft 32 is supported for rotation in a crankcase assembly formed at the lower end of the cylinder block 27 by a crankcase member 33 that is detachably affixed to the cylinder block 27. The crankshaft 32 rotates about a vertically extending axis so as to facilitate its coupling to a drive shaft 34 which depends into a drive shaft housing and lower unit assembly 35.

Continuing to refer to the construction of the engine 25 and primarily to the cross-sectional view of FIG. 1, a cylinder head assembly 36 is affixed to the cylinder block 27 in a known manner to close the opposite ends of the cylinder bores from those closed by the crankcase member 33. The cylinder head 36 is formed with individual recesses 37 in the surface that mates with this end of the cylinder block 28. These recesses 37 cooperate with the pistons 29 and cylinder bore 28 to form the combustion chambers of the engine. Since, at top dead center, the cylinder head recesses 37 form the substantial portion of the clearance volume of the combustion chamber, at times the reference numeral 37 will also be utilized to identify the combustion chamber per se.

Intake passages 38 are formed in the cylinder head 36 for serving each of the combustion chambers 37. These intake passages 38 terminate in intake valve seats which are valved by intake valves 39 that are supported in the cylinder head assembly 36 in a known manner. The intake valves 39 are closed by coil compression springs (not shown) and are opened by the lobe of an intake camshaft 41. The intake camshaft 41 is journaled in a suitable manner in the cylinder head assembly 36. In addition, the intake camshaft 41 is driven at one-half crankshaft speed from the crankshaft 32 by a suitable valve train drive (not shown).

An induction system, indicated generally by the reference numeral 42, supplies an atmospheric air charge to the intake passages 38. This induction system 42 is comprised of an intake device 43 that draws air from within the protective cowling 26 through a plurality of air openings 44. This air is admitted to the interior of the protective cowling 26 through a rearwardly facing air inlet opening 45 formed in a suitable manner in the cowling 26.

The air inlet device 43, in turn, delivers the air to an induction system silencer 46 that is disposed in the power head adjacent the crankcase member 33. A throttle body 47 receives the air from the silencer 46 and delivers it to a surge tank or plenum chamber 48. A throttle valve 49 is provided in the throttle body 47 for controlling the air flow and, accordingly, the speed and power output of the engine 25. The throttle valve 49 is controlled in a manner which will be described.

A plurality of intake manifold runners 51 interconnect the surge tank 48 with the individual cylinder head intake passages 38. By providing relatively long length for the intake manifold runner 51, they may be tuned to provide optimum engine performance.

Fuel injectors 52 are mounted in the cylinder head assembly 36 and spray into the cylinder head intake passages 38 in a direction toward the intake valve seats and combustion chambers 37. The fuel injector 52 are supplied with high pressure regulated fuel through a fuel supply system that includes a fuel rail 53 that communicates directly with the nozzle inlet port of the injectors 52. In a preferred embodiment of the invention, the fuel injector 52 are electrically operated, for example, by a means of a solenoid control valve so as to control the timing and duration of fuel injection.

The fuel air charge which is delivered to the combustion chamber 37 is fired by means of spark plugs 54 that are mounted in the cylinder head assembly 36 and which have their spark gaps protruding into the combustion chamber recess 37.

An ignition coil 55 is mounted on each spark plug 54 for supplying a high voltage charge to the spark plug 54 for igniting the fuel charged. The ignition coils 55 are, in turn, fired by means of an ignition system, shown schematically at 56 and which will be described in some more detail later.

The charge which is burning within the combustion chambers 37 will drive the pistons 29 downwardly for affecting rotation of the crankshaft 32 in a well-known manner. At the completion of the power or expansion stroke, the upstroke of the pistons 29 causes the exhaust gases to be discharged through exhaust passages 57 formed in the cylinder head assembly 36.

These exhaust passages 57 begin at exhaust valve seats that are valved by exhaust valves 58 which are mounted for reciprocation in the cylinder head assembly 36 in a known manner. Like the intake valves 39, the exhaust valves 58 are urged toward their closed positions by coil compression springs which are not shown. An exhaust camshaft 59 is journaled in the cylinder head assembly 36 and driven like the intake camshaft 41 in a suitable manner. This exhaust camshaft 59 has individual cam lobes that operate the exhaust valves 58 in a well-known manner.

The exhaust passages 57 of the cylinder head communicate with an exhaust manifold 61 which may be formed integrally within a body of the engine 25. These exhaust gases are then delivered downwardly for discharge through a conventional type of exhaust system utilized in outboard motors and which may include a high-speed underwater discharge and a low-speed above the water idle discharge. These types of systems are well known in the art.

The propulsion system of the outboard motor 21 will now be described by principal reference to the lower portion of FIG. 1. It has been noted that the drive shaft 34 depends into the drive shaft housing and lower unit 35. This drive shaft 34 is journaled in a suitable manner in the drive shaft housing and lower unit 35.

The lower end of the drive shaft 35 has affixed to it a bevel drive gear 62 of a conventional bevel gear forward/reverse neutral transmission, indicated generally by the reference numeral 63. This transmission 63 includes, in addition to the drive gear 63, a forward drive bevel gear 64 and a reverse drive bevel gear 65. These gears 64 and 65 are engaged with the diametrically opposite sides of the drive gear 62 so that they will be rotated in opposite directions.

These gears 64 and 65 are journaled in a suitable manner on a propeller shaft 66 to which a propeller 67 is affixed in a known manner. A dog-clutching element 68 is splined onto the propeller shaft 56 and is shifted into engagement with either the forward drive bevel gear 64 or the reverse drive bevel gear 65 so as to effect forward or reverse rotation of the propeller 67. This thus forms a propulsion system 70 of the outboard motor 21. The manner in which the propulsion system 70 is shifted will be described shortly.

It has been noted that the outboard motor 21 is attached to the transom 22 of the watercraft 23. This attachment mechanism includes, among other things, a clamping bracket 69 which is detachably affixed to the transom 22. The clamping bracket 69 pivotally supports a swivel bracket by means of a tilt pin 71. This permits tilt and trim movement of the outboard motor 21 relative to the hull 23 in a manner that is well-known in this art. The swivel bracket, in turn, supports the outboard motor 21 for steering movement about a vertically extending steering axis. As has been noted, these constructions are conventional and, for that reason, have not been illustrated and will not be described in any more detail. Those skilled in the art can readily practice the invention utilizing known constructions.

The output of the engine 25 and the condition of the transmission 63 is controlled generally by a single lever control, indicated generally by the reference numeral 72. This single lever control 72 is depicted in FIG. 1 and its various positions will later be described by reference to FIG. 3.

Basically, the single lever control 72 includes a control box 73 mounted in an appropriate position within the hull 23. A control lever 74 is supported for pivotal movement by this control box 73 in an appropriate manner. This control lever 74 can be moved from a neutral position indicated at A to a full throttle forward drive position B, and a full throttle reverse drive position C.

A wire actuator 75 provides a mechanical connection between the control lever 74 and a shift control mechanism which includes a shift rod 76 that is journaled in the drive shaft housing and lower unit 35 in a known manner. A shift cam 77 is carried by the lower end of the shift rod 76 and cooperates with a known type of plunger mechanism for shifting the dog-clutching element 78 from the neutral position, shown in FIG. 1, to a forward drive position A where the clutching teeth of the dog-clutching element 68 engage clutching teeth on the forward drive gear 64 for driving the propeller 66 in a forward drive direction.

Movement in the opposite direction from the neutral position causes reverse clutching teeth of the dog-clutching element 68 to engage with dog-clutching teeth on the reverse drive gear 65 for coupling the reverse drive gear 65 with the propeller shaft 66 for driving it in a reverse direction, as is well-known in its art.

Figure 3:
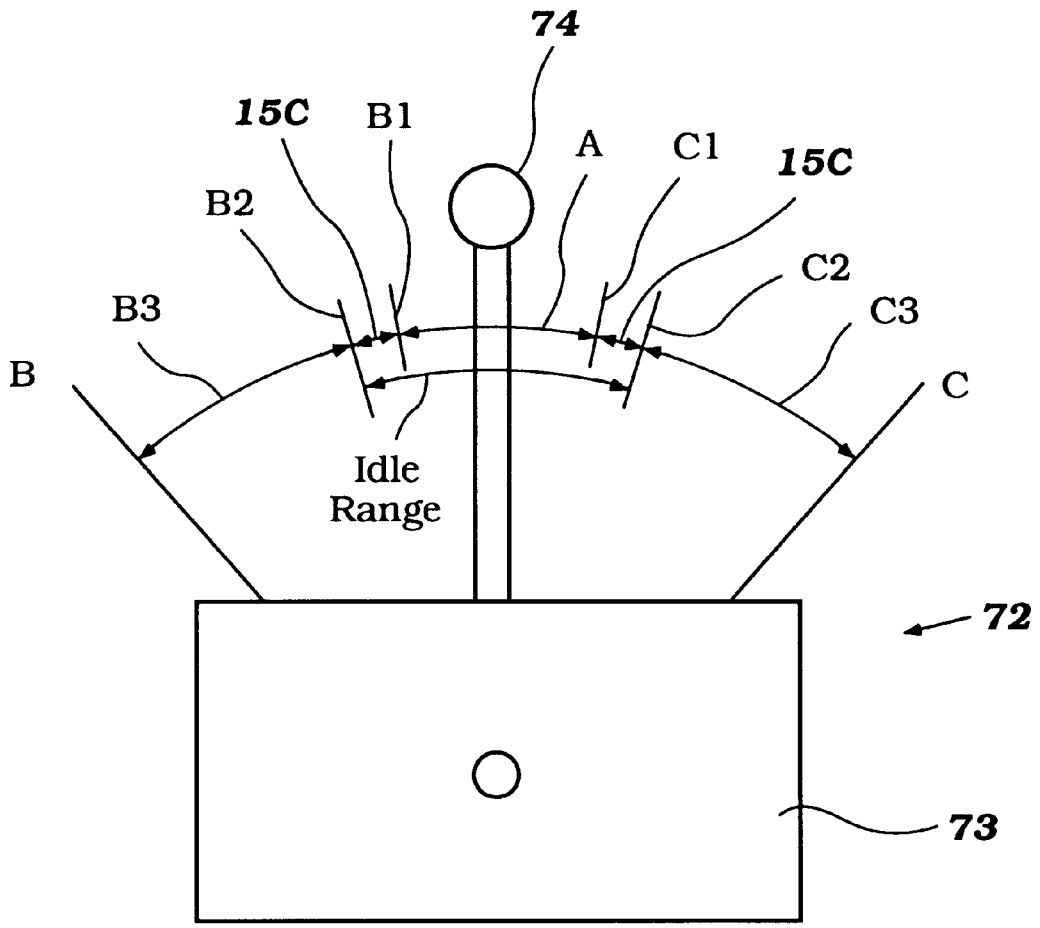
FIG. 3 is an enlarged side elevational view of the single lever control for the marine propulsion system and shows the varying control ranges.

As is also well-known in the art, the single lever control 72 is operative so that pivotal movement of the lever 74 from the neutral A position through a first range of movement indicated by the neutral range A in FIG. 3 merely takes up lost motion in the movement of the dog-clutching element 68 toward either forward or reverse engaged positions. The forward-engaged position begins at the point B1 where the dog-clutching teeth of the clutching element 68 first engage the teeth on the forward drive gear 64 and continues to the fully-engaged position B2. In the fully-engaged position B2, the dog-clutching teeth are in full engagement. During this movement, the throttle valve 49 is retained in its idle position. Thereafter, continued movement through the range B3 merely is effective to increase the speed of the engine 25, in a manner which will be described.

In a like manner, movement in the opposite direction to the position C1 causes the dog-clutching teeth of the clutching element 68 to begin their engagement with the teeth on the reverse drive gear 65. Full engagement occurs at the point C2. During this movement, the throttle valve 49 is retained in its idle position. Thereafter, continued movement of the control lever 74 through the range C3 merely is effective to increase the speed of the engine 25.

In the range between the point B1 and B2 and C1 and C2, there is a range of idle speed control, indicated at ISC in FIG. 3. During this condition, the idle speed is controlled in a manner which will be described, in accordance with the invention. The entire idle speed range is indicated by the area so designated in FIG. 3.

In accordance with a feature of the invention, a position sensor, indicated generally by the referenced numeral 78 is associated with the single level control 72 and provides an output signal to an ECU 79 which is indicative of the position of the lever 73 and, accordingly, the operators demand for power on the engine 25. The ECU receives other input signals, as will be described shortly, and outputs a control signal to a servo motor 81 that positions the throttle valve 49 so as to maintain the desired power output from the engine 25.

However, in the idle range, the throttle valve 49 is held in its fully closed position. Idle speed is controlled by an idle by-pass circuit 82 that is comprised of a flow line 83 that extends across the opposite sides of the throttle valve 49 so as to provide an air flow past the throttle valve 49 when in its closed position. A solenoid controlled or stepper type valve 84, which is operated by the ECU 79, controls the air flow through the line 83 and, accordingly, the idle speed in combination with the control of the ignition circuit 56, which is also controlled by the ECU 79 in the manner to be described.

As has been noted, in addition to the throttle position sensor 88, the ECU 79 receives a number of other signals indicative of varying conditions for engine control. Next will be described the sensors that provide these signals and the conditions which are sensed. These are merely typical of those signals which can be sensed for the engine control and those skilled in the art will readily understand how additional or alternative conditions can be sensed.

Specifically, there is provided a crankshaft position sensor 85 which is associated with the crankshaft 32 and which provides a signal indicative of the number of rotations of the crankshaft 32 and, accordingly, engine speed. Associated with one of the cam shafts 41 and 59, and specifically the exhaust cam shaft 59, is a cylinder indicator sensor 86 that provides a signal which provides a signal which indicates when a certain cylinder, such as cylinder number 1, is at its top or bottom dead center position. This is done so that the specific firing of the individual cylinders is controlled in the appropriate order.

Associated with the induction system 42 and specifically the plenum chamber 48 is an atmospheric or induction air pressure sensor 87 that provides a signal to the ECU 79 indicative of the air pressure in the intake system or the atmospheric supply thereto.

A throttle position sensor 88 is associated with the throttle valve 49 and provides a feedback signal indicative of the actual position of the throttle valve 49.

The engine 25 is water cooled and a temperature sensor 89 is associated with the cooling jacket in the cylinder block 27 to provide the ECU 79 with a signal of actual engine operating temperature.

Watercraft speed also maybe be sensed for engine control. Thus, a watercraft speed sensor 89 is associated with the hull 23 and provides a vessel speed signal to the ECU 79.

Finally, and in accordance with an important feature of the invention, there is provided a manually operated trolling speed control switch 91 which permits the operator to select, at his option, a control mode, to be described, whereby the trolling speed is controlled. As should be apparent from the foregoing description, the actual trolling speed is substantially less than idle speed.

This embodiment operates to provide two features which control the engine speed during shifting and also which control the engine speed when trolling so as to maintain a more uniform speed. This is done, in this embodiment, by controlling the spark advance and by employing a different form of timing curve during the shifting mode and when trolling.

Figure 5:
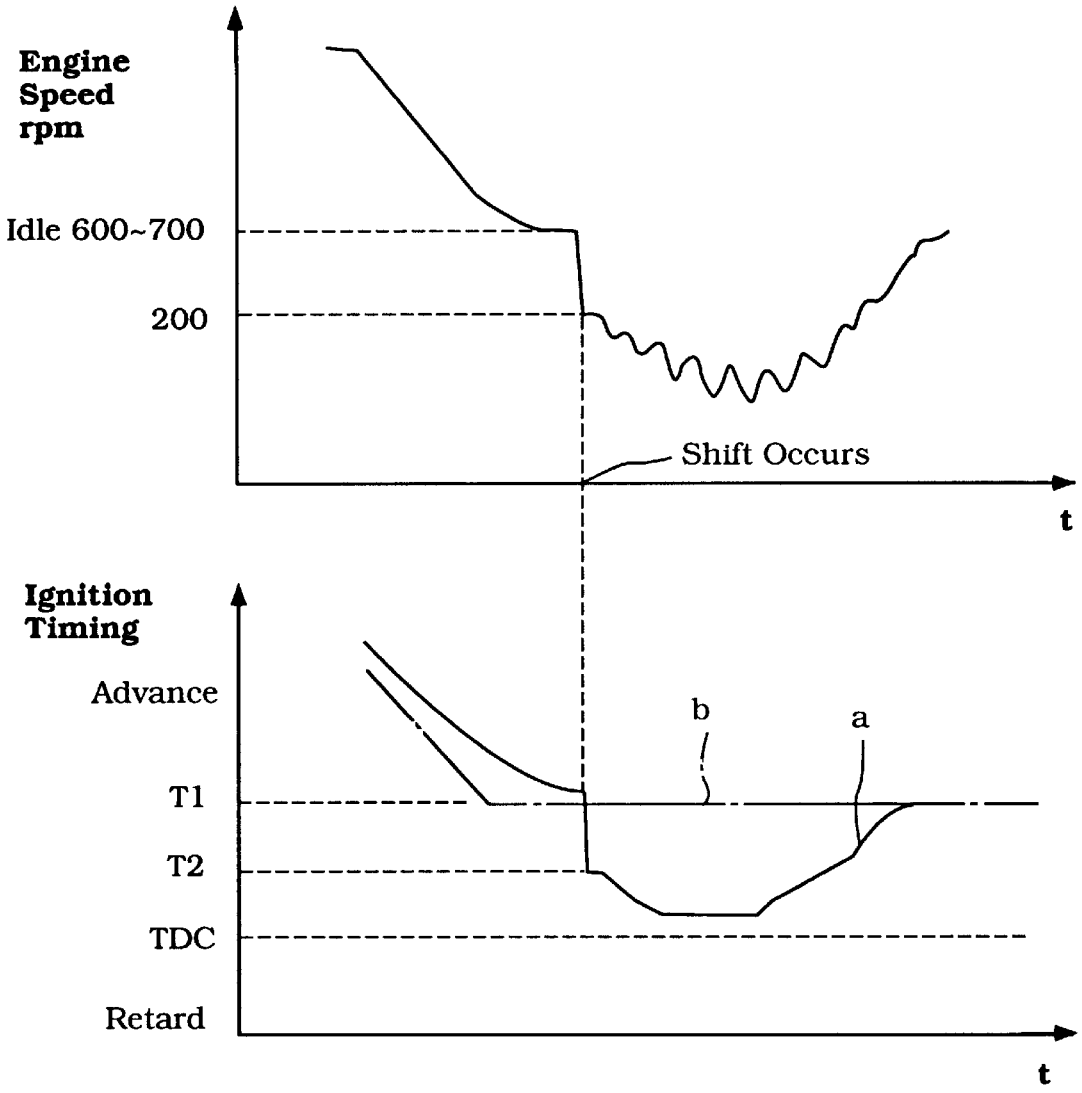
FIG. 5 is a graphical view showing, in the upper portion, the speed variations during certain running conditions including trolling and, in the lower portion, the ignition timing utilized in accordance with the prior art (curve b) and in accordance with the invention (curve a).

This may be understood best by reference to FIG. 5 and specifically the lower graph in this figure which shows ignition timing verses elapsed time during a mode where engine speed is reduced, a shift in transmission condition is accomplished and then trolling is initiated.

Conventional spark advance mechanisms for engines, and particularly those utilized in watercraft, normally hold a fixed spark advance at idle and on off idle up until a certain predetermined speed. When this predetermined speed is reached, then the spark is advanced in a somewhat linear function as the engine speed increases. The spark advance may then be held at a fixed, more advanced setting once a high predetermined speed is reached and then held at that fixed spark advance.

The lower portion of FIG. 5 shows in the dot dash graph portion indicated at "b" the conventional spark timing mechanism. This shows a situation when the engine is being gradually slowed and it will be seen that the spark advance reduces gradually in a linear function until the timing T1. Then the spark advance is maintained constant until the engine speed is increased again above the speed at which the timing is held fixed. However, although this provides good idling characteristics, it does cause some difficulties when shifting, and also does not provide good running when trolling.

Figure 4:
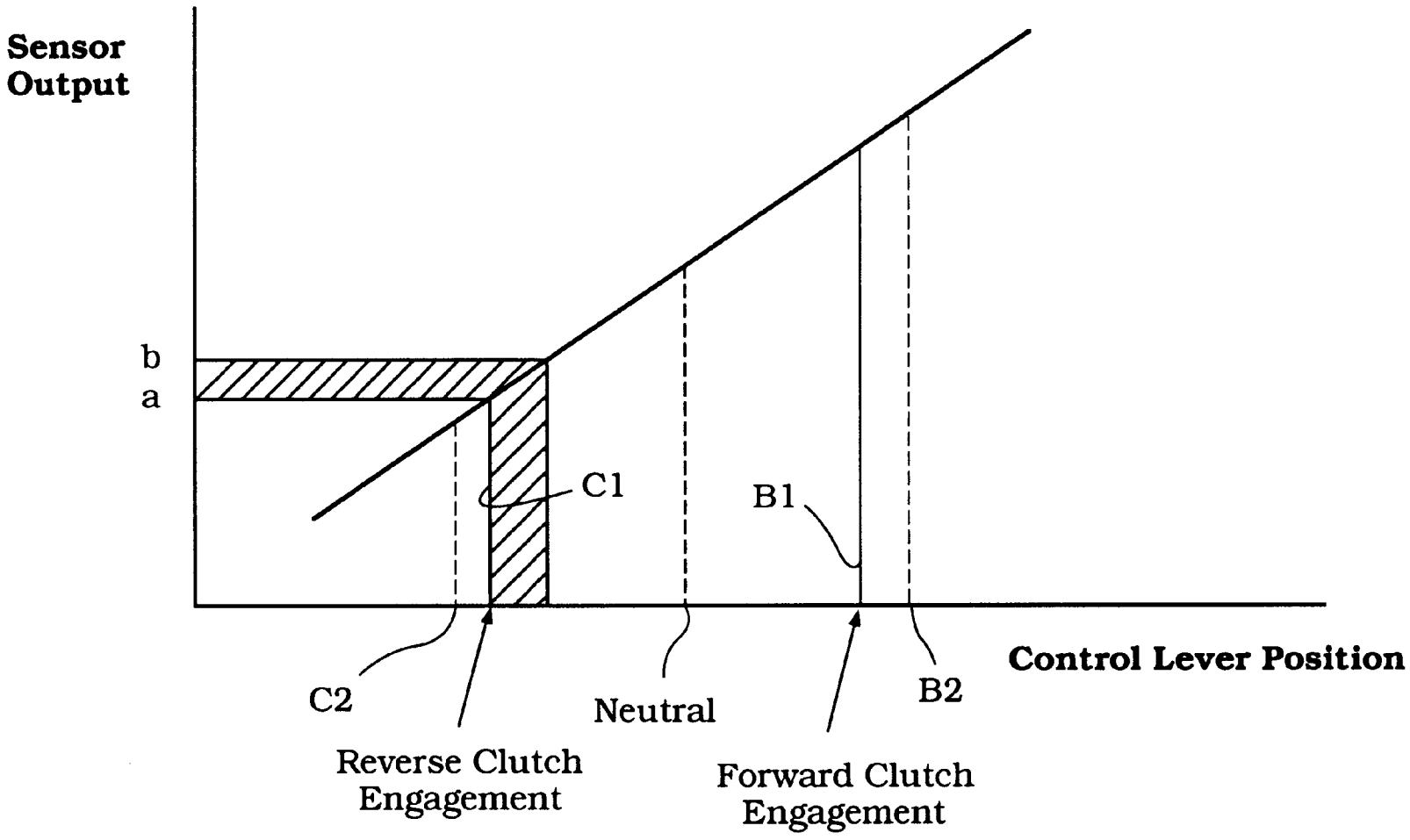
FIG. 4 is a graphical view that is partially related to FIG. 3 and shows the output of a position sensor associated with the single lever control and shows the range of control movements between neutral and forward and reverse drive conditions and also illustrates the conditions during engagement of the clutches.

Therefore, in accordance with the invention, the sensor 78 provides a signal which indicates when the shift lever is being moved from the neutral position toward a condition when the dog clutch 68 will be engaged with one of the gears 64 or 65, as may be seen in FIG. 4. The condition described in the example is one where there has been forward travel, the engine speed is then reduced as the lever 74 (FIG. 3) is moved to the neutral range and then the transmission is shifted into reverse. It will be apparent to those skilled in the art how the same procedure is followed with other shifts from neutral to drive.

The shift point at which the shifting and engagement of the reverse gears actually begins is indicated at the point a or C1 in FIG. 4. However, in accordance with a feature of the invention, at a point before this, indicated as the point b, the engine speed is slowed significantly so as to improve the ability to engage the gears. This is done by providing an abrupt drop in the spark advance or a retardation to the value T2 so that the spark plugs are fired closer to top dead center position, as shown in the curve a in the lower portion of FIG. 5.

This provides a speed reduction down to a substantially lower than idle speed and in the illustrated embodiment this speed is approximately 200 rpm. Thus, shifting is facilitated and the wear on the transmission is reduced. The same is done when shifting into forward and FIG. 4 only shows an example of shifting in the one of the two directions from neutral.

Having accomplished the shift, if the operator decides to operate in a trolling mode, he depresses the trolling button 91. The ECU 79 then places the condition in a trolling mode by retaining the throttle valve 49 in the idle position, even though the shift lever may be moved beyond the point necessary to engage the gears. That is, the operator cannot overspeed the engine when operating in this idle mode.

In addition, and as shown in FIG. 5, this causes rather irregular running of the engine and instantaneous engine speed varies considerably due to the uneven and incremental firing impulses. Thus, the spark retarded even further controlled in accordance with another spark advance map which is more retarded than the conventional spark timing as shown by the solid curve a at the lower portion of FIG. 5. This further retardation in spark advance from the conventional fixed advance of the spark curve b provides smoother running and will insure against stalling. To release this mode, the operator merely need depress the trolling switch 91 again and the system will return to normal control.

Alternatively the trolling mode may be sensed by the controller 79 monitoring certain conditions. For example, if the shift control is in an engaged position and the throttle valve 49 is held closed, the operator of the watercraft may desire to troll. If the engine speed is then sensed to be at a sub-idle speed or at a predetermined, very low speed, such as 200 rpm, trolling may be assumed.

Figure 6:
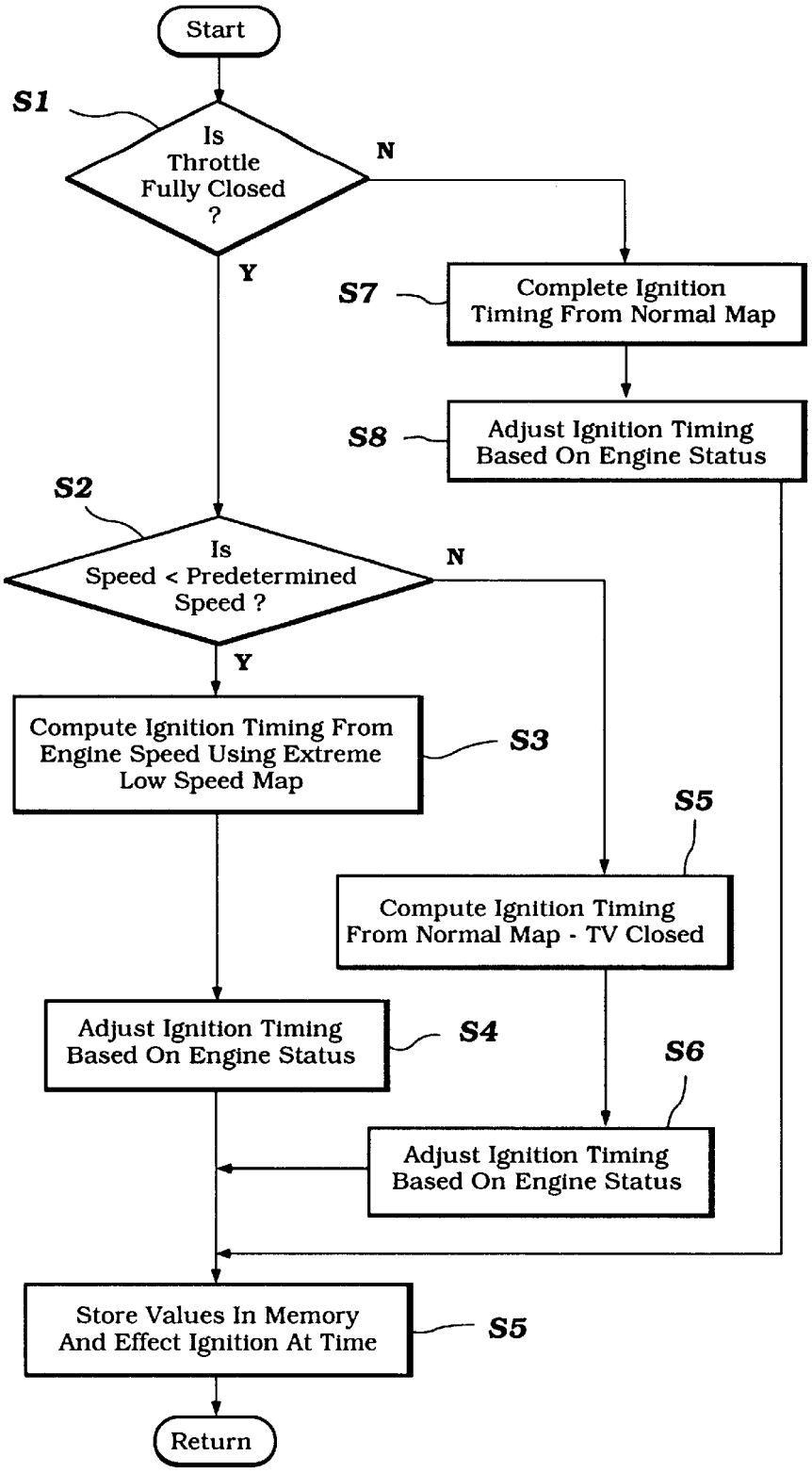
FIG. 6 is a block diagram showing the control routine employed in conjunction with this embodiment.

The control routine by which this is accomplished is shown in FIG. 6 and will now be described by reference to that figure. When the program starts, it moves to the step S1 to determine if the throttle valve from 48 has been moved to its fully closed position. If it has, the program then moves to the step S2 to determine if the speed of operation of the engine 25 is below the predetermined speed. This predetermined speed is a speed that is set lower than idle speed, as noted above.

If the speed is below this speed, then the program moves to the step S3 so as to compute the engine timing from engine speed using the special afore noted extreme low speed map having substantially retarded timing. The program then moves to the step S4 so as to adjust the timing based upon the actual engine running condition.

If, however, it is determined at the step S2 that the engine speed is not less than the predetermined engine speed, the program moves to the step S5 so as to look up the desired engine timing from the normal timing map for conditions when the throttle valve is closed. The program then moves to the step S6 so as to adjust the engine timing based upon the observed engine status.

If, however, at the step S1, the throttle valve is not determined to be fully closed, then the program moves to the step S7 so as to look up the ignition timing from the normal map related to engine speed. The program then moves to the step S8 so as to adjust the engine timing based upon the engine status.

Regardless of whether the timing has been set at the steps S4, S6 or S8, the program advances to the step S9. At this step, the values are stored in a volatile memory and the ignition is effected at the appropriate time determined at the steps S4, S6 or S8. The program then returns.

Figure 7:
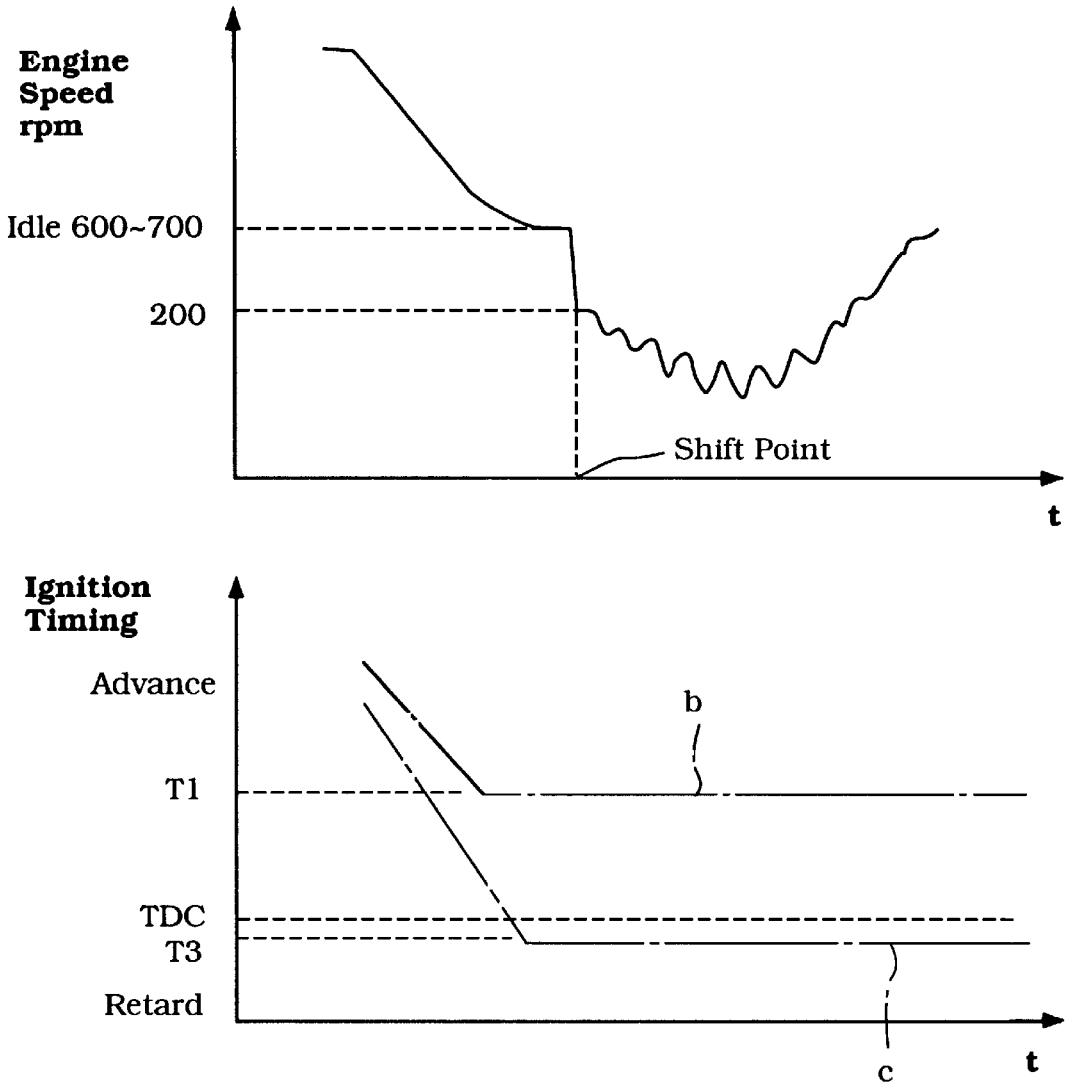
FIG. 7 is a two-part graphical view, in part similar to FIG. 5, and shows a second embodiment of the invention.

FIGS. 7–10 show another embodiment of the invention, this dealing primarily with an arrangement for improving the engine stability at trolling. In accordance with this feature of the invention,conventirk timing curve is again varied from that utilized in a conventional engine with this embodiment's timing curve being shown in FIG. 10. Basically, the timing curve follows the same general slope as a conventional timing curve for engines. However, this system differs from the conventional system in that under speeds below a predetermined speed slightly above idle, the spark timing is actually retarded so that it occurs not before but after top dead center. In conjunction with this, the maximum spark retardation is such that the spark firing occurs at 5° after top dead center. Thus, when a shift occurs, the spark timing is retarded to this point, and the engine speed will drop as shown in FIG. 7 so as to assist in the shift operation.

Figure 8:
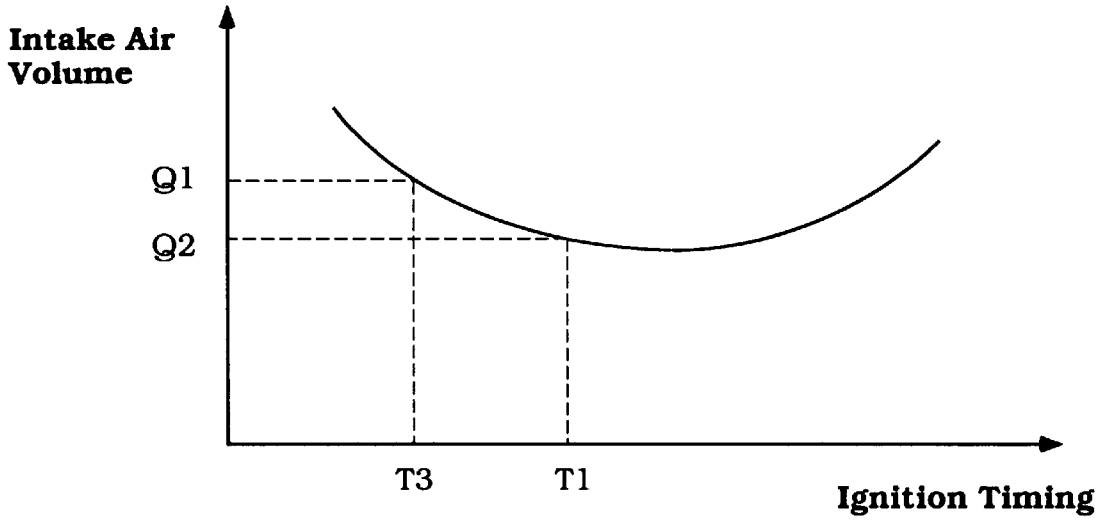
FIG. 8 is a graphical view showing the intake air volume and ignition timing strategy in connection with this second embodiment.
Figure 9:
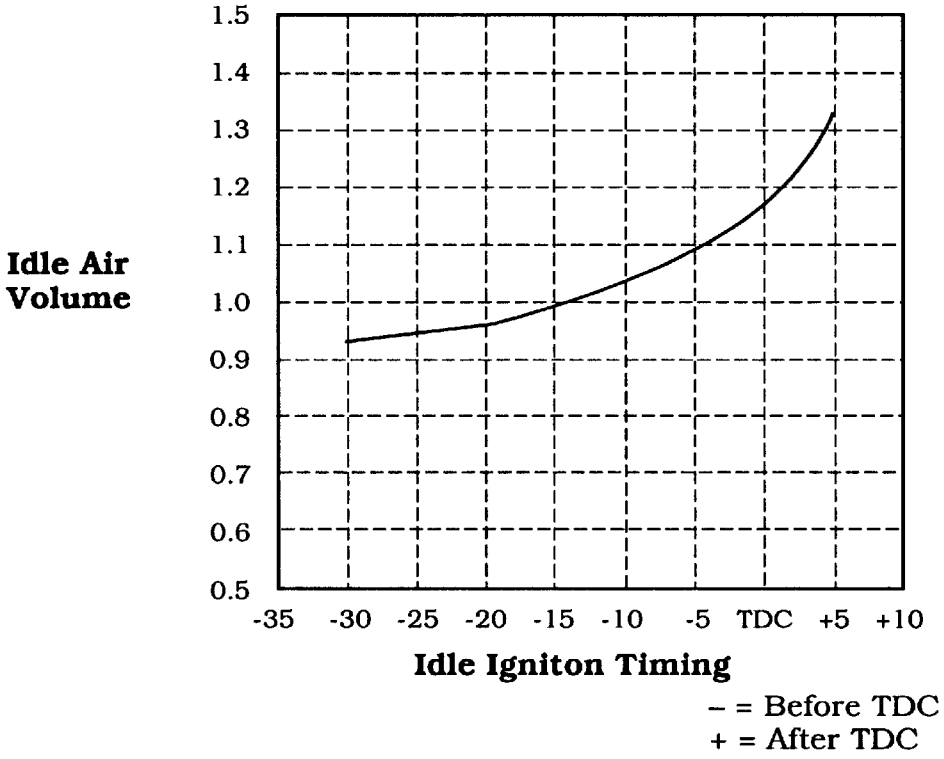
FIG. 9 is a graphical view showing how the intake air volume is adjusted relative to the idle ignition timing in accordance with this second embodiment.

In addition to this, the trolling speed is stabilized by increasing the intake air volume. This may be done by either opening the throttle valve 49 with its servo motor 81 or by adjusting the idle bypass valve 84. This effect is shown in FIGS. 8 and 9. At the time T1, which is the conventional point when the spark advance on a conventional engine is held stationary, the intake air volume is indicated at Q2. However, by decreasing the spark advance to 5° after top dead center at the point T3, the idle air volume is increased by about 30% over that at normal spark timing of 15° before top dead center. Idle or sub-idle air flow may be increased by operating either the idle air flow valve 84, the throttle valve 49 or both. Fuel flow may also be adjusted accordingly. This assists in maintaining idle stability. This condition and control methodology is used both at idle and also at sub-idle speeds including at trolling.

It has been noted that there are certain sensors provided and specifically the crank angle sensor 85 that output information to the ECU 79 for the control strategy. Although during normal running conditions, this is quite acceptable, when operating at the extreme low trolling speeds, a problem presents itself in connection with engine speed control. This problem can be best understood by reference to FIG. 11 which is a graphical view showing how instantaneous engine speed varies during these slow speed trolling operations.

As may be seen in this figure, if the trolling speed is intended to be in the range of 200–300 rpm, there is a significant instantaneous speed variation which occurs at the time each cylinder is fired and its expansion stroke occurs. Showing the specific firing order of 1, 3, 4, 2, when cylinder number 1 is at a top dead center position on its firing stroke, it will have been fired and the expansion of the gases will cause the engine to be driven and accordingly the speed will increase until bottom dead center. The speed then decreases.

When the next cylinder to fire, number 3, fires, this same cycle will repeat and hence, the speed varies, in the illustrated example from 200 rpm to 300 rpm on an instantaneous basis. Referring the lower portion of this figure, it will be seen that a timing impulse indicated at d, will be outputted from the sensor which occurs sometime shortly after bottom dead center in the specific example.

At this time, the crankshaft speed is almost at its highest. But when the spark plug is to be fired for the next cylinder, the speed will have decreased substantially. The spark plug timing desired is shown at the point $d_2$ and this occurs at a time $t_2$ after the impulse signal has been generated. Thus, the engine speed at the time of actual spark firing will be substantially different than that when the signal impulse was given out. Thus, the spark timing may be off from the desired timing.

Next will be described a series of routines that can be employed in order to compensate for this condition and to ensure that the spark timing is appropriate for the actual crankshaft rotational speed at the time the spark plug 54 is fired.

Figure 12:
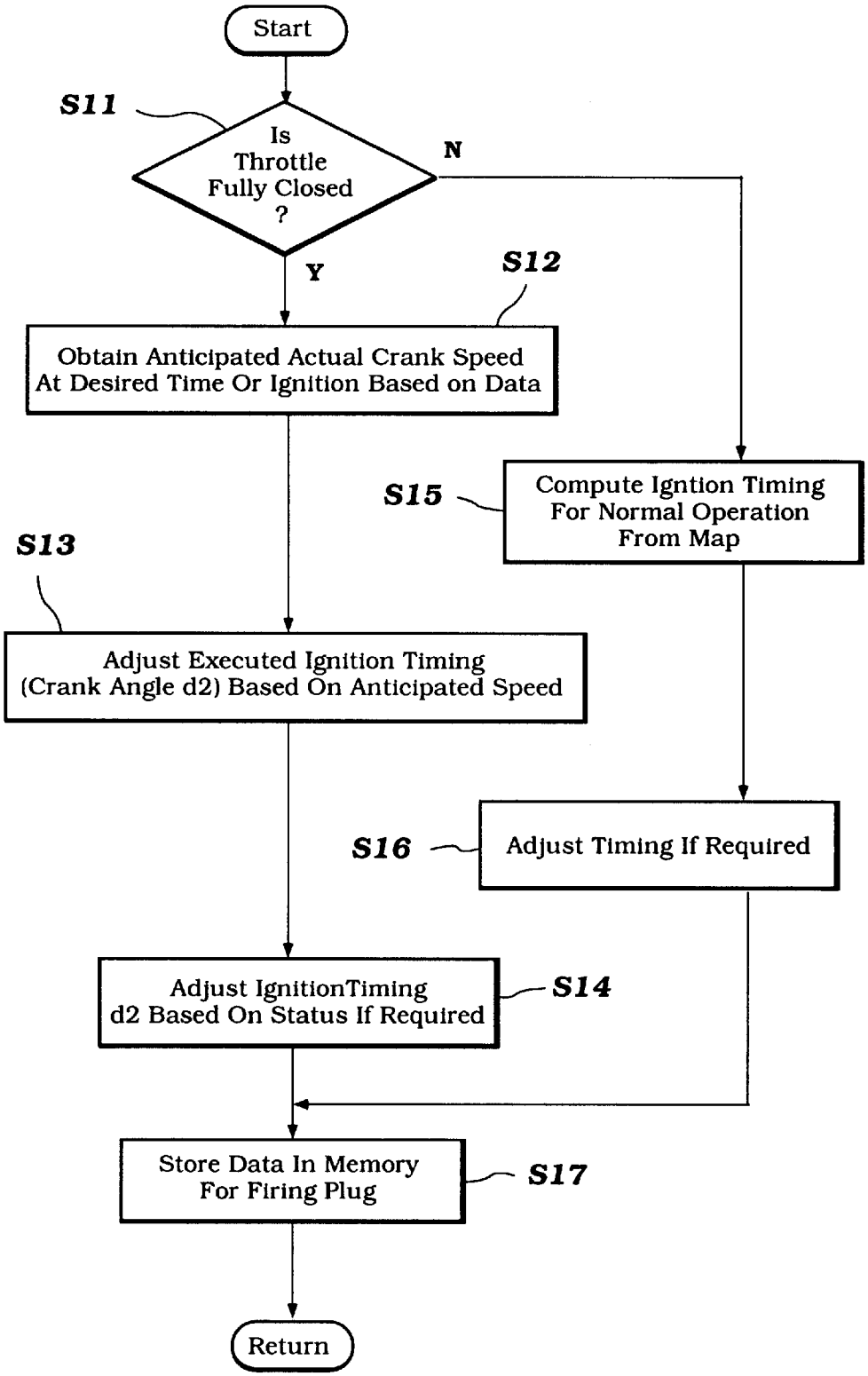
FIG. 12 is a block diagram showing the theory of how the control is effected in accordance with a third embodiment of control routine.

The theory of control routine for achieving this result is illustrated in FIG. 12 and this describes the basic strategy for compensating for these variations under extreme low engine speeds.

The program starts and then moves to the step S11 to determine if the throttle valve 49 is in its fully closed position. If it is, the program then moves to the step S12 to obtain the data of the anticipated actual speed of rotation of the crankshaft 32 at the desired time of ignition. This is done based upon collected data that is obtained by measuring the instantaneous crankshaft speed at varying crank ankles in relation to cylinder firing so as to develop mapped data conforming to the curve shown in FIG. 11 for varying actual engine speeds.

The program then moves to the step S13 so as to make an effective adjustment in the timing angle $d_2$ which is based upon the anticipated speed at the time of firing.

The program then moves to the step S14 and an adjustment is made in the set timing if the value determined at S13 is not the one set previously set for the ignition circuit.

If, however, at the step S11 it is determined that the throttle valve is not fully closed, then the program moves to the normal control routine at the step S15. At the step S15, the engine speed and other parameters are sensed and the desired engine timing ignition timing is determined from a standard map.

The program then moves to the step S16 so as to make any necessary adjustment in the previously set timing if required from the data determined from the map reading at step S15.

Thus, proceeding from either the steps S14 or step S16 depending upon the position of the throttle valve 49, the data for the ignition timing is stored in a memory so that at the appropriate crank angle or time $d_2$ the spark plug will be fired.

Figure 13:
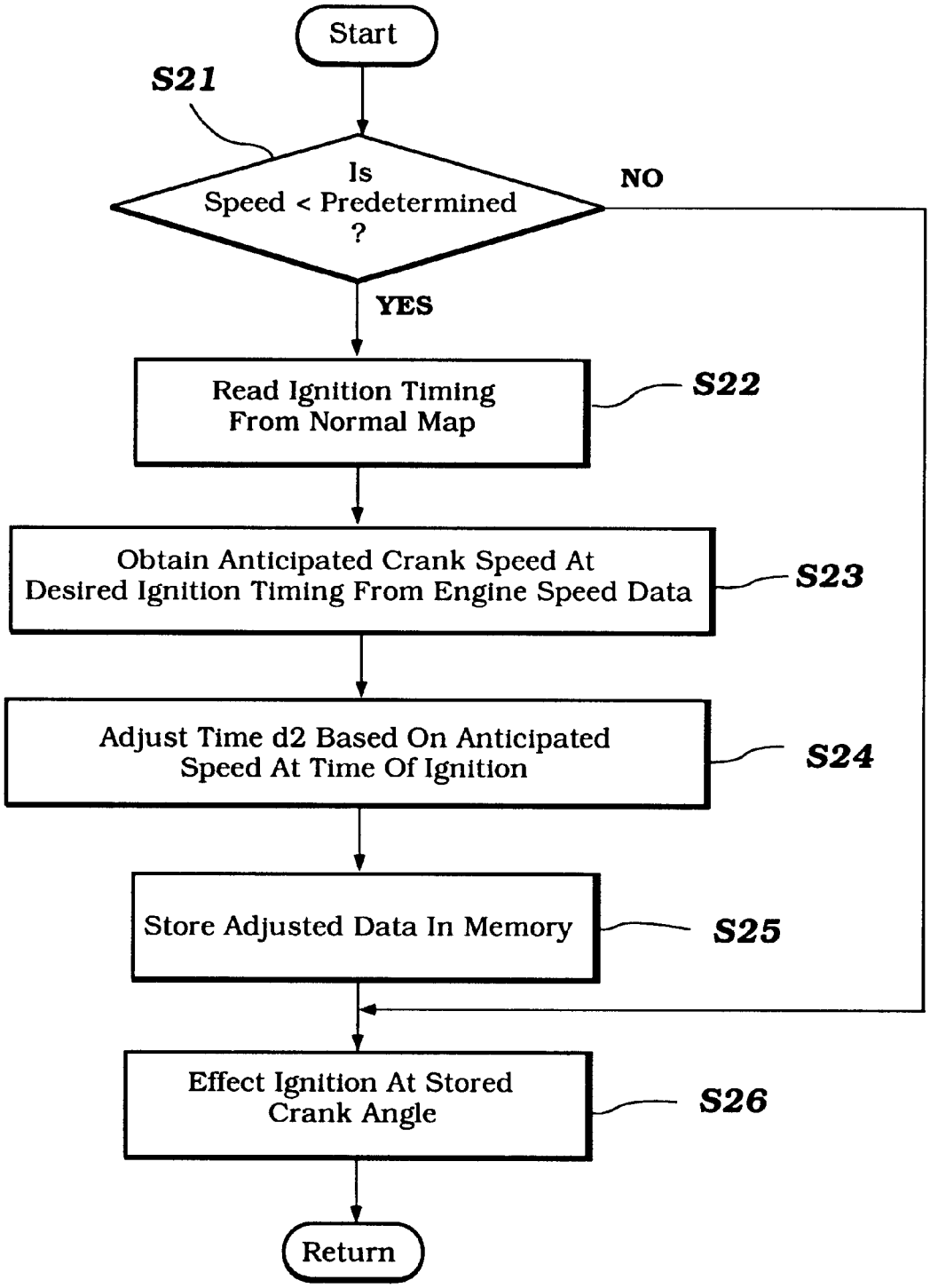
FIG. 13 is a block diagram showing one way of affecting the third embodiment of control routine.

As may be seen, the obtaining of the actual optimal ignition timing point $d_2$ can be achieved in two ways. One is to wait the time $t_2$ after the impulse signal $d_1$ is received and then effect the firing. The other is to wait until the time $d_2$ is reached and then affecting the cylinder firing at this time. FIG. 13 shows the latter method of how this is done.

Figure 10:
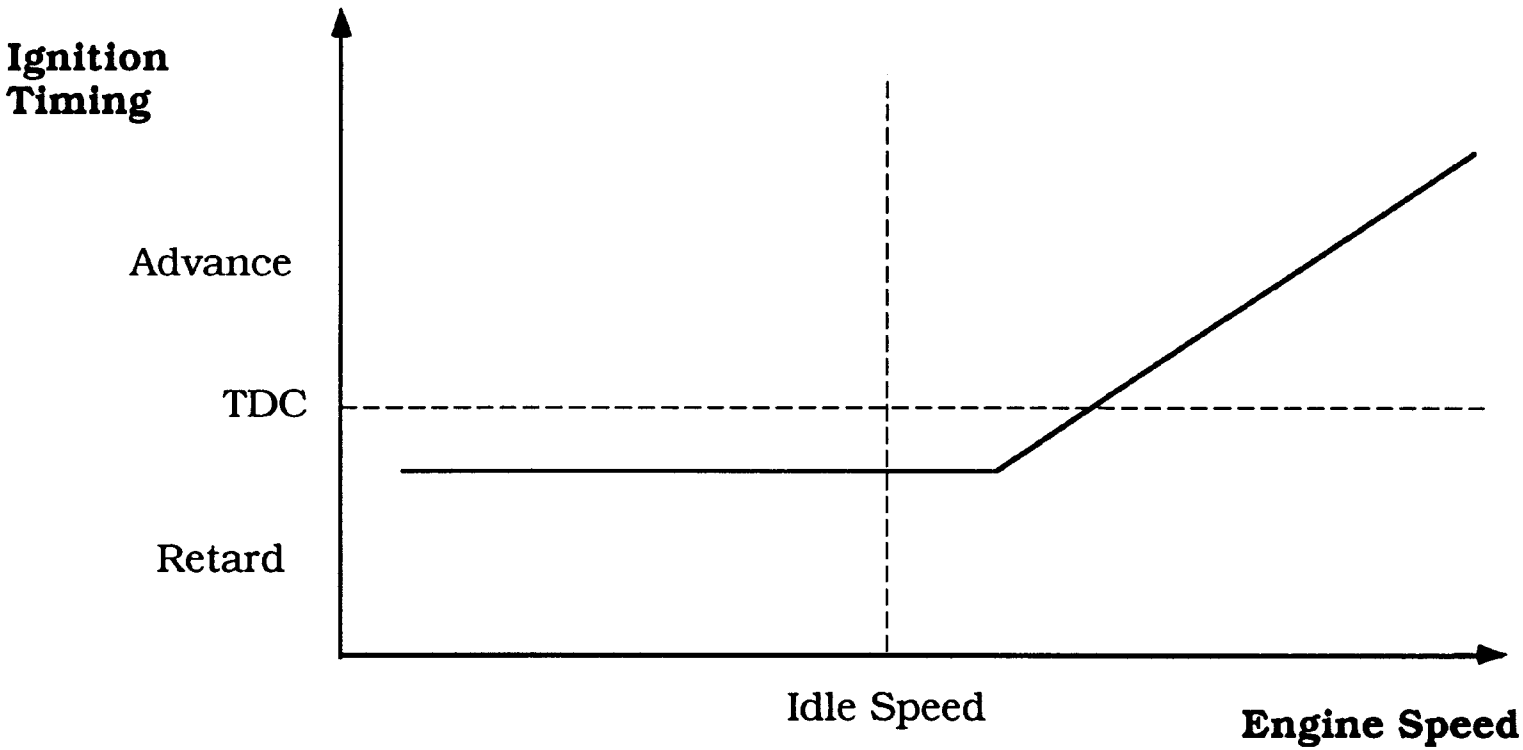
FIG. 10 is a graphical view showing how the ignition timing is related to engine speed in accordance with this second embodiment.

In accordance with this routine, the program starts and moves to the step S21 so as to read the actual crankshaft speed and compare it with a predetermined speed which will indicate whether or not the engine is operating at a speed where the effect shown in FIG. 10 will be significant. This is when operating at relatively low trolling speeds, as afore noted.

If the speed is below the speed, the program moves to the step S22 so as to read the desired ignition timing from a map.

Figure 11:
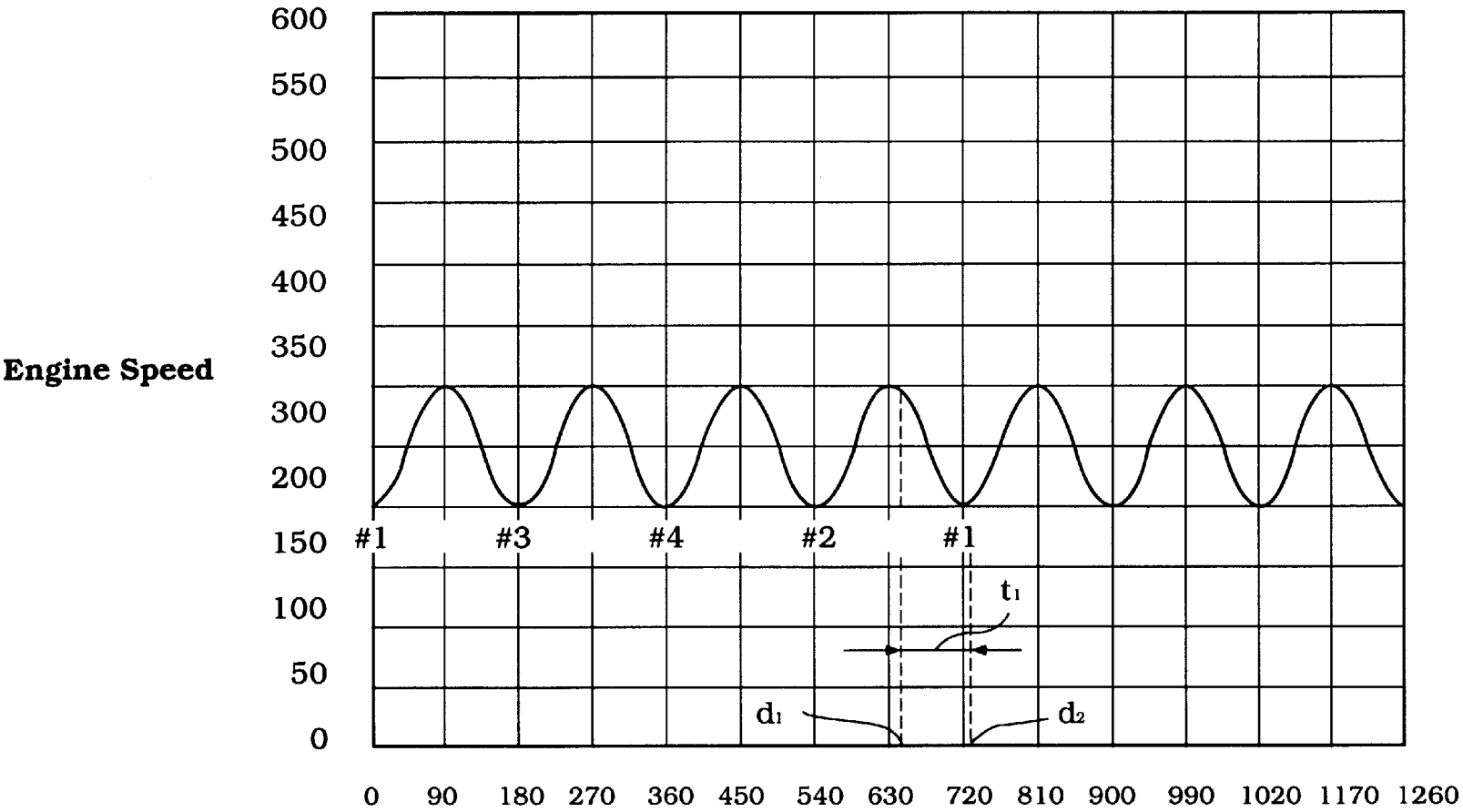
FIG. 11 is a graphical view showing how the engine speed varies cycle to cycle and how the timing is controlled in accordance with a third and fourth embodiments of the invention.

The program then moves to the step S23 to compute the anticipated crank speed at the desired ignition timing from engine speed data. This is done from reading the stored data from maps based upon actual test results which show data as seen in FIG. 11.

The program then moves to the step S24 so as to adjust the time $d_2$ based upon the anticipated engine speed at the time of ignition.

The program then moves to the step S25 to store this data in the memory and, at the appropriate time the ignition is then effected as seen at step S26.

Figure 14:
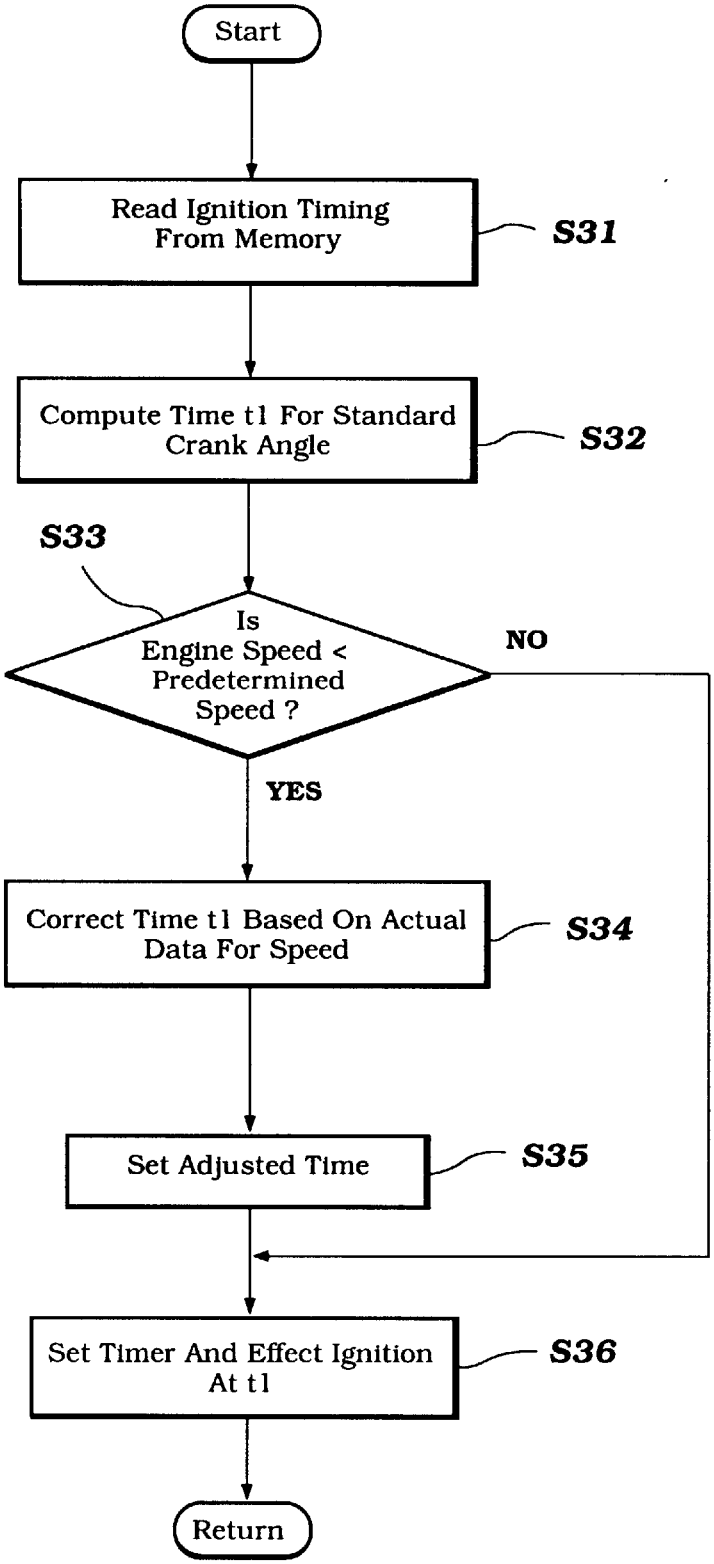
FIG. 14 is a block diagram showing how the control is effected in accordance with another way the third embodiment of control routine is effected.

FIG. 14 illustrates how the time $t_1$ is established to obtain the appropriate ignition timing in accordance with a possible other control routine. The program begins and moves to the step S31 to read the actual ignition timing from a map based upon engine running conditions.

The program then moves to the step S32 so as to compute the time t, from which the appropriate firing angle $d_2$ can be accomplished.

The program then moves to the step S33 to determine if the engine speed is below the predetermined engine speed. Again, this is done so as to determine if the engine is running at such a low speed that adjustment in the timing is required to compensate for instantaneous crankshaft speed variations.

If the speed is determined to be below the predetermined speed at the step S33, the program then moves to the step S34 so as to determine the correction in the time value $t_1$ based upon actual observed data determined from engine speeds and variations under extreme low conditions accumulated as set forth above and based upon maps having data as shown in FIG. 11.

The program then sets most to the step S34 to make the necessary adjustment in the timing $t_1$ so as to compensate for the actual engine condition.

Then at the step S36 a timer is set based upon either the data determined at the step S33 from step S32 or based upon the adjusted data from the step S35 depending upon the answer obtained at the step S33. The timer is then set and the ignition is affected once the appropriate crank time has elapsed.

Figure 15:
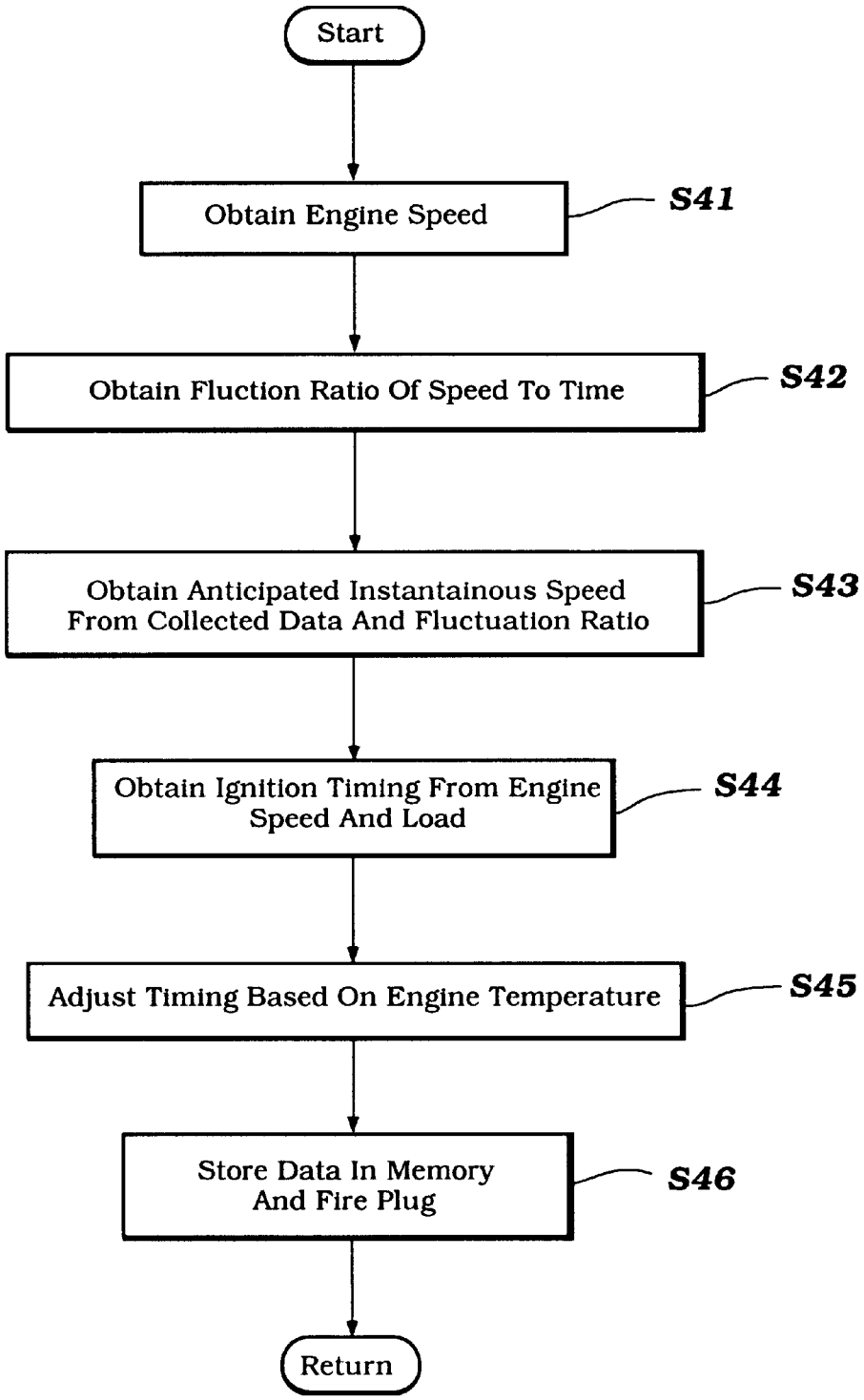
FIG. 15 is a block diagram showing how data is stored in accordance with a fourth embodiment of control routine.

FIG. 15 is a block diagram showing another control routine that can be utilized to compensate for variations in engine speed. In accordance with this routine, the program starts and then moves to the step S41 so as to read instantaneous engine speed. At the step S42 there is obtained a calculation of fluctuation ratio of speed relative to time to compare the speed with the instantaneous speed at another time to obtain data that indicates how the speed fluctuates in the given time period.

The program then moves to the step S43 so as to obtain anticipated instantaneous speed from the collected data and fluctuation ratio.

The program then moves to the step S44 so as to obtain the ignition timing desired from a map based upon engine speed and load characteristics.

Then at the step S45, further adjustments may be made based on other sensed parameters. For example, the timing may be changed depending upon engine temperature.

The program then moves to the step S46 to store the data in a memory for firing the spark plug at the appropriate time.

Figure 16:
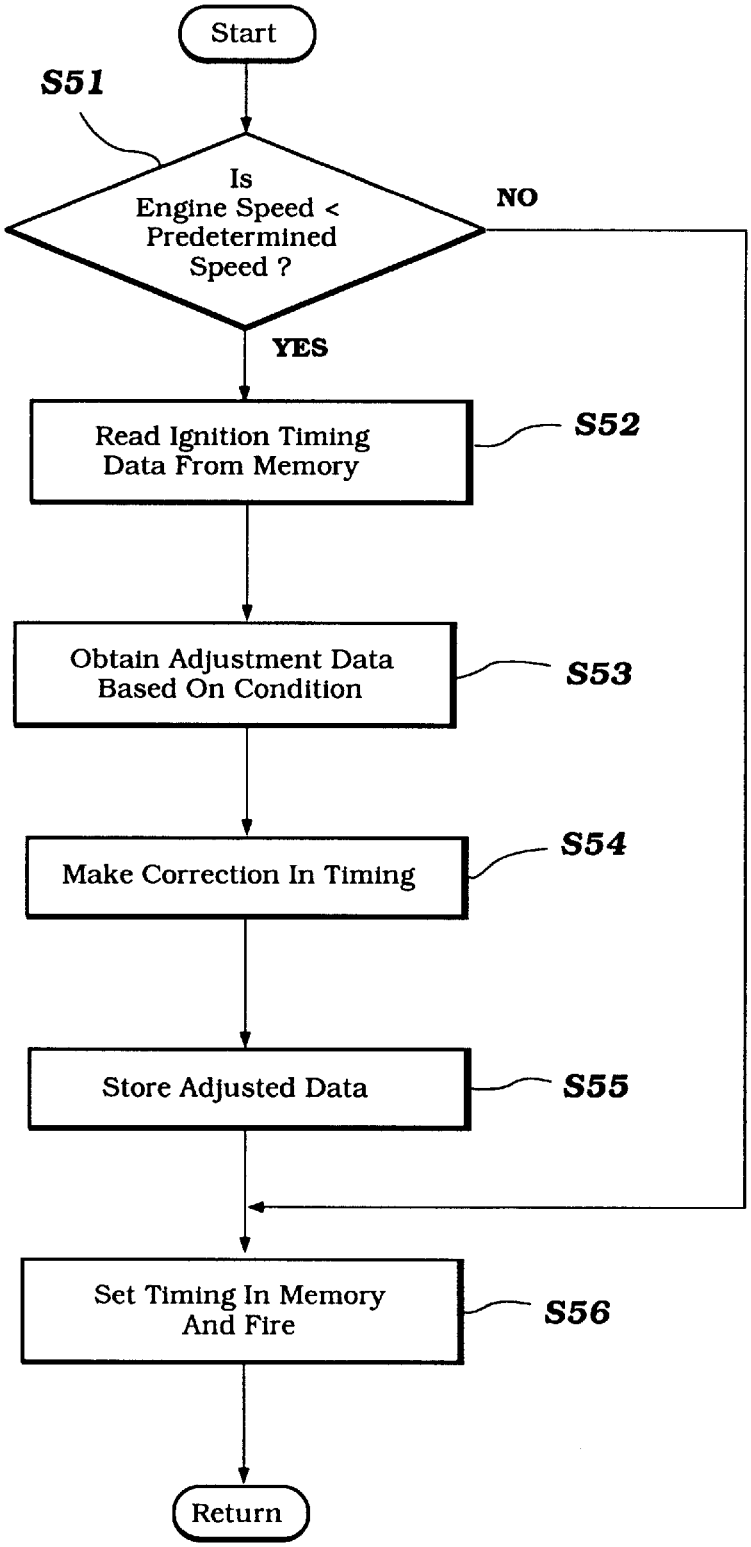
FIG. 16 is a block diagram showing how the control is effected in accordance with the fourth embodiment of control routine.

FIG. 16 then shows how this data is employed to affect spark plug firing depending upon whether or not the engine is operating at an abnormally low speed such as trolling. Referring specifically to this figure, the program begins and moves to the step S51 to compare the actual engine speed with the predetermined speed i.e., the trolling speed.

If the speed is below the predetermined speed, the program then moves to the step S52 to read the target ignition timing data from the memory. This is the data that has been stored at the step S46 in FIG. 15.

The program then moves to the step S53 so as to make an adjustment in this data based upon variations in engine speed determined from maps bearing data like that shown in FIG. 11.

The program then moves to the step S54 so as to make a correction based upon the timing. This is done to ensure that the ignition timing occurs at the appropriate crank angle for the anticipated engine speed at the time of firing, as afore noted.

The program then moves to the step S55 so as to store the adjusted data.

At the step S56, the timing determined either at the step S55 or S51 is stored in a memory and then the spark plug is fired at the appropriate time.

Thus, from the foregoing description it should be readily apparent that the described constructions and methods permit the obtainment of good smooth shifting and also stable trolling speeds and absence of stalling even though the engine runs at an abnormally low speed and one well below idle speed. The smooth running is obtained by appropriate adjusting either or both of the spark timing and/or airflow.

Of course, the foregoing description is that of preferred embodiments of the invention, and various changes and modifications may be made without departing from the spirit and scope of the invention, as defined by the appended claims.

What is claimed is:

1. A control system for operating an engine having at least one combustion chamber, an induction system for supplying a charge to said combustion chamber, an ignition system for firing said charge in said combustion chamber and an exhaust system for discharging the burnt charge from said combustion chamber, said control system controlling at least said ignition system for maintaining the desired engine running characteristics during normal running between idle and wide open throttle conditions by providing a first spark timing at idle and a spark timing that advances along a curve with speed at least a range of speeds above idle, and means for employing a different form of control strategy from the normal engine control strategy when the engine is operating at a sub-idle speed including retarding the spark timing from said first spark timing.

2. A control system for operating an engine as set forth in claim 1, wherein the spark timing is retarded from the first spark timing when the speed of said engine falls below idle speed by a predetermined amount.

3. A control system for operating an engine as set forth in claim 2, wherein the spark timing is retarded to a point after top dead center when the speed of said engine falls below idle speed by the predetermined amount.

4. A control system for operating an engine as set forth in claim 2, wherein the engine drives a load through a transmission shiftable between a neutral and a drive condition and the spark is retarded upon shifting from neutral drive.

5. A control system for operating an engine as set forth in claim 1, wherein there is provided an operator control for affecting a retardation in the spark timing from the first spark timing when the engine is operating at the sub-idle speed.

6. A control system for operating an engine as set forth in claim 1, wherein the induction system includes a throttle valve and the control retards the spark timing when the throttle valve is closed and increases the air flow to the engine.

7. A control system for operating an engine having at least one combustion chamber, an induction system having a throttle valve for supplying a charge to said combustion chamber, an ignition system for firing said charge in said combustion chamber and an exhaust system for discharging the burnt charge from said combustion chamber, said control system controlling at least one of said systems for maintaining the desired engine running charateristics during normal running between idle and wide open throttle conditions, and means for retarding the spark timing to a point after top dead center advance when the speed of said engine is at idle speed.

8. A control system for operating an engine as set forth in claim 7, wherein the control retards the spark timing when the throttle valve is closed and increases the air flow to the engine.

9. A control method for operating an engine having at least one combustion chamber, an induction system having a throttle valve for supplying a charge to said combustion chamber, an ignition system for firing said charge in said combustion chamber and an exhaust system for discharging the burnt charge from said combustion chamber, said method comprising the steps of controlling at least one of said systems for maintaining the desired engine running characteristics during normal running between idle and wide open throttle conditions, and retarding the spark timing to a point after top dead center advance when the speed of said engine is at idle speed.

10. A control method for operating an engine as set forth in claim 9, wherein the spark timing is retarded when the throttle valve is closed and further including the step of increasing the air flow to the engine.

* * * * *

UNITED STATES PATENT AND TRADEMARK OFFICE

CERTIFICATE OF CORRECTION

PATENT NO. : 6,098,591

DATED : August 8, 2000

INVENTOR(S) : Yoshibumi Iwata

It is certified that error appears in the above-identified patent and that said Letters Patent is hereby corrected as shown below:

Column 3, line 1, delete "affecting" and insert -- effecting--.

Column 5, line 8, delete "affecting" and insert -- effecting--.

Column 9, line 47, delete "conventirk" and insert -- the spark --.

Column 11, line 22, delete "affecting" and insert -- effecting--.

Column 13, line 28, Claim 5, delete "affecting" and insert -- effecting--.

Signed and Sealed this

Eighth Day of May, 2001

*Attest:*

Nicholas P. Godici

NICHOLAS P. GODICI

*Attesting Officer*

*Acting Director of the United States Patent and Trademark Office*